US008047778B2

(12) United States Patent
Kasperski et al.

(10) Patent No.: US 8,047,778 B2
(45) Date of Patent: Nov. 1, 2011

(54) METHOD AND APPARATUS FOR INSURING PROPER INSTALLATION OF STATORS IN A COMPRESSOR CASE

(75) Inventors: Donald Joseph Kasperski, Simpsonville, SC (US); Dwight Eric Davidson, Greer, SC (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 12/349,270

(22) Filed: Jan. 6, 2009

(65) Prior Publication Data

US 2010/0172755 A1 Jul. 8, 2010

(51) Int. Cl.
*F01D 9/04* (2006.01)

(52) U.S. Cl. ..... 415/209.3; 29/889.22

(58) Field of Classification Search ..... 415/209.3, 415/189, 190, 208.2, 208.3, 208.4, 209.4, 415/211.1; 29/889.22
See application file for complete search history.

(56) References Cited

U.S. PATENT DOCUMENTS

| | | | | |
|---|---|---|---|---|
| 4,889,470 | A * | 12/1989 | Scalzo | 415/209.2 |
| 5,022,818 | A * | 6/1991 | Scalzo | 415/209.3 |
| 5,129,783 | A * | 7/1992 | Hayton | 415/209.3 |
| 5,141,395 | A * | 8/1992 | Carroll et al. | 415/196 |
| 5,584,654 | A * | 12/1996 | Schaefer et al. | 415/209.3 |
| 5,846,050 | A * | 12/1998 | Schilling | 415/135 |
| 6,296,443 | B1 * | 10/2001 | Newman et al. | 415/209.2 |
| 6,722,848 | B1 * | 4/2004 | Couture et al. | 415/209.2 |
| 6,908,279 | B2 * | 6/2005 | Sullivan et al. | 415/191 |
| 6,984,108 | B2 | 1/2006 | Anderson et al. | |
| 7,179,052 | B2 * | 2/2007 | Sasaki et al. | 415/209.3 |
| 7,618,234 | B2 * | 11/2009 | Brackett et al. | 415/119 |
| 7,845,900 | B2 * | 12/2010 | Roduner et al. | 415/127 |
| 2004/0001757 | A1 * | 1/2004 | Shapiro et al. | 416/215 |
| 2004/0086383 | A1 * | 5/2004 | Couture et al. | 415/209.4 |
| 2005/0111973 | A1 * | 5/2005 | Sullivan et al. | 415/209.2 |
| 2006/0228213 | A1 * | 10/2006 | Bracken | 415/209.2 |
| 2008/0193290 | A1 * | 8/2008 | Brackett et al. | 415/209.3 |
| 2009/0053056 | A1 * | 2/2009 | Finneran et al. | 415/209.3 |

* cited by examiner

*Primary Examiner* — Ross Gushi
(74) *Attorney, Agent, or Firm* — Cantor Colburn LLP

(57) ABSTRACT

Disclosed herein is a compressor case assembly that includes a compressor case section having an assembly track and a set of stator portions that are insertable in the assembly track, the compressor case section and the set of stator portions are configured such that the set of stator portions only assembles to the compressor case section in a single configuration.

19 Claims, 5 Drawing Sheets

METHOD AND APPARATUS FOR INSURING PROPER INSTALLATION OF STATORS IN A COMPRESSOR CASE

BACKGROUND OF THE INVENTION

The subject matter disclosed herein relates to axial compressors. More particularly, the subject relates to the installation of stator vanes in an axial compressor.

An axial compressor consists of both rotating and stationary components. A shaft drives a central drum, which has a number of annular rotors. Rotor sections rotate between a similar number of stationary stator sections, each stator section attached to a stationary outer tube case. Each of the sections of rotors and stators include a plurality of vanes around which airflow passes. Compressors often utilize complex non-uniform vane schemes or other asymmetric vane arrangements for various reasons both within each section, and between different sections. Non-uniform vane schemes utilize differently shaped vanes in addition to differently angled vanes. In the case of each stator vane section, these non-uniform schemes must be assembled in specific circumferential locations along the compressor case section in order to have the desired effect. The art would therefore be receptive to a method and apparatus for insuring the proper installation of stator vanes.

BRIEF DESCRIPTION OF THE INVENTION

According to one aspect of the invention, a compressor case assembly that includes a compressor case section having an assembly track and a set of stator portions that are insertable in the assembly track, the compressor case section and the set of stator portions are configured such that the set of stator portions only assembles to the compressor case section in a single configuration.

According to another aspect of the invention, a method of insuring proper installation of stator portions to a compressor case includes inserting a set of stator portions into an assembly track of the compressor case, the assembly track and the set of stator portions each are keyed such that each of the stator portions only assemble to the compressor case in a single configuration.

According to yet another aspect of the invention, a method of insuring proper installation of stator portions to a compressor case includes keying an assembly track of the compressor case and keying each of a set of stator portions such that the set of stator portions only assemble to the compressor case in a single configuration.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Referring to FIGS. 1-6, an embodiment of a compressor case assembly section 10 is illustrated. Compressor case assembly section 10 is a section of half of a compressor (not shown). The compressor case assembly section includes a compressor case section 11, and a set of stator portions 12, 14, 16 is shown installed into an assembly track 18 of the compressor case section 10. The stator portions 12, 14, 16 have a non-uniform blade scheme and are assembled in a specific order in the assembly track 18 to accomplish the desired scheme. The stator portions 12, 14, 16 and the assembly track 18 have complementary features that prevent the connection and assembly of the set of stator portions 12, 14, 16 in any configuration other than that illustrated.

Figure 1:
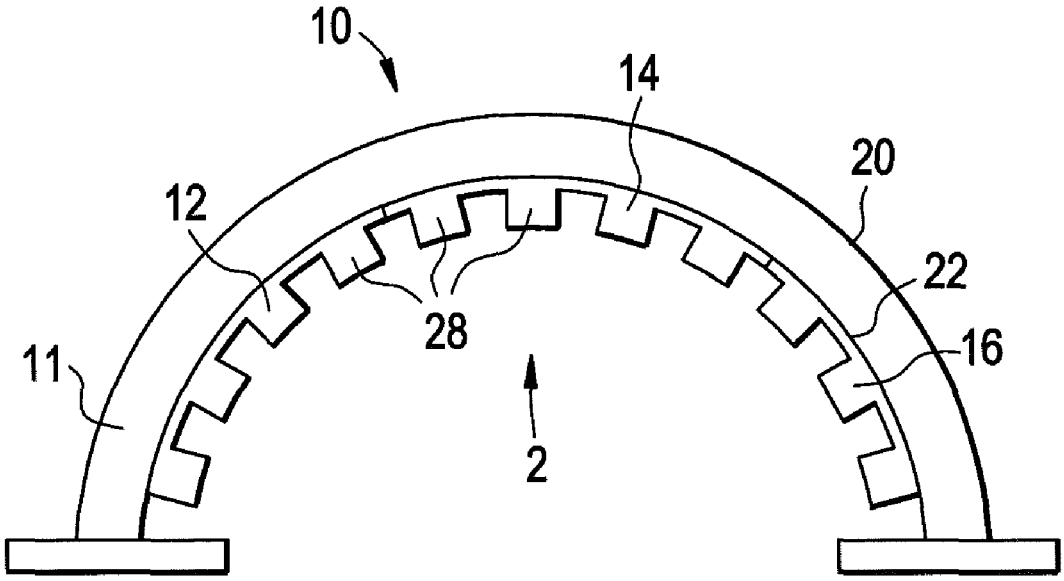
FIG. 1 is an elevation view of half of a compressor case section having a first stator portion, a second stator portion, and a third stator portion installed in accordance to one embodiment of the present invention.
Figure 2:
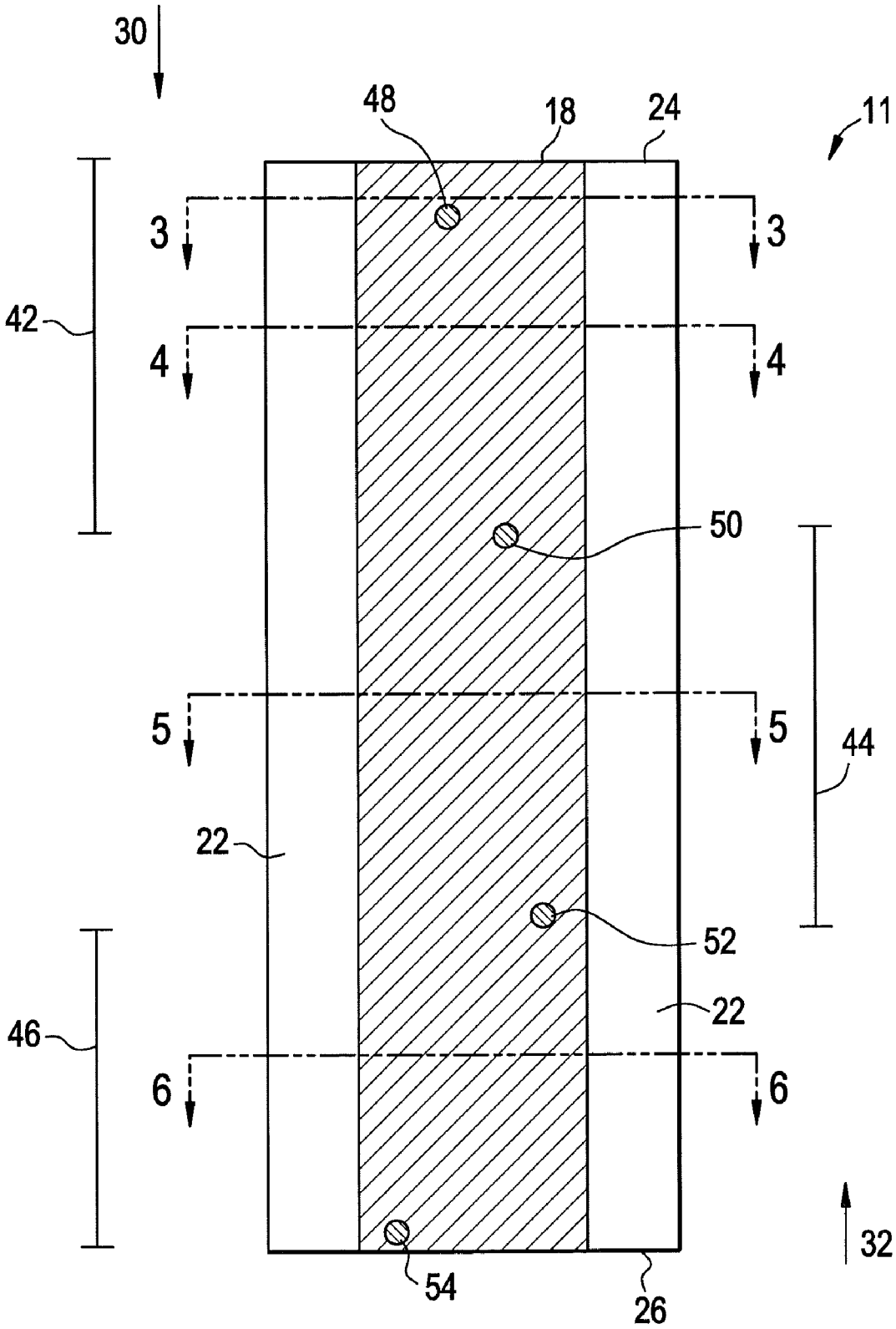
FIG. 2 is an elevation view of an inner surface of an assembly track of the compressor case section of FIG. 1 as viewed along arrow 2, with the stator portions removed.
Figure 3:
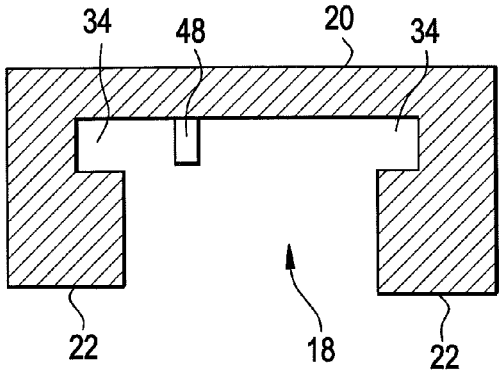
FIG. 3 is a cross sectional view of the compressor case section of FIG. 2, taken along arrows 3-3, showing an assembly track and a protrusion.
Figure 4:
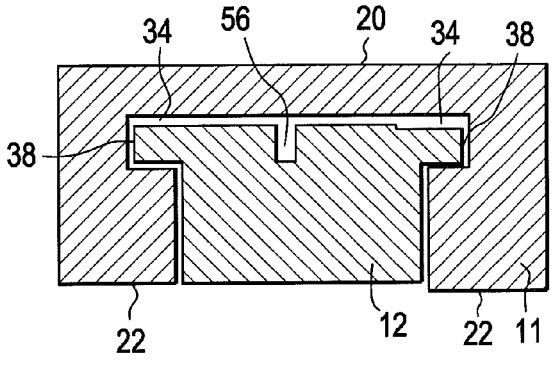
FIG. 4 is a cross sectional view of a first stator portion within the compressor case section of FIG. 1 at a first assembly location taken along arrows 4-4.
Figure 5:
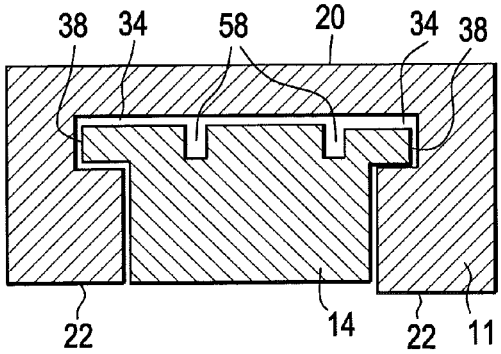
FIG. 5 is a cross sectional view of a second stator portion within the compressor case section of FIG. 1 at a second assembly location taken along arrows 5-5.
Figure 6:
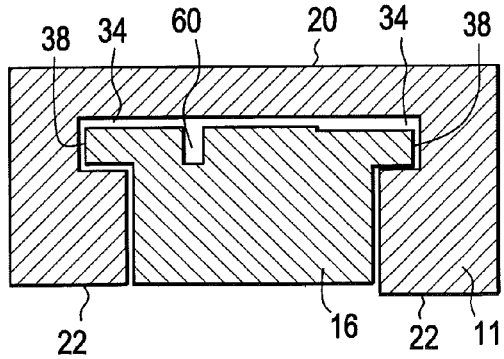
FIG. 6 is a cross sectional view of a third stator portion within the compressor case section of FIG. 1 at a third assembly location taken along arrows 6-6.
Figure 7:
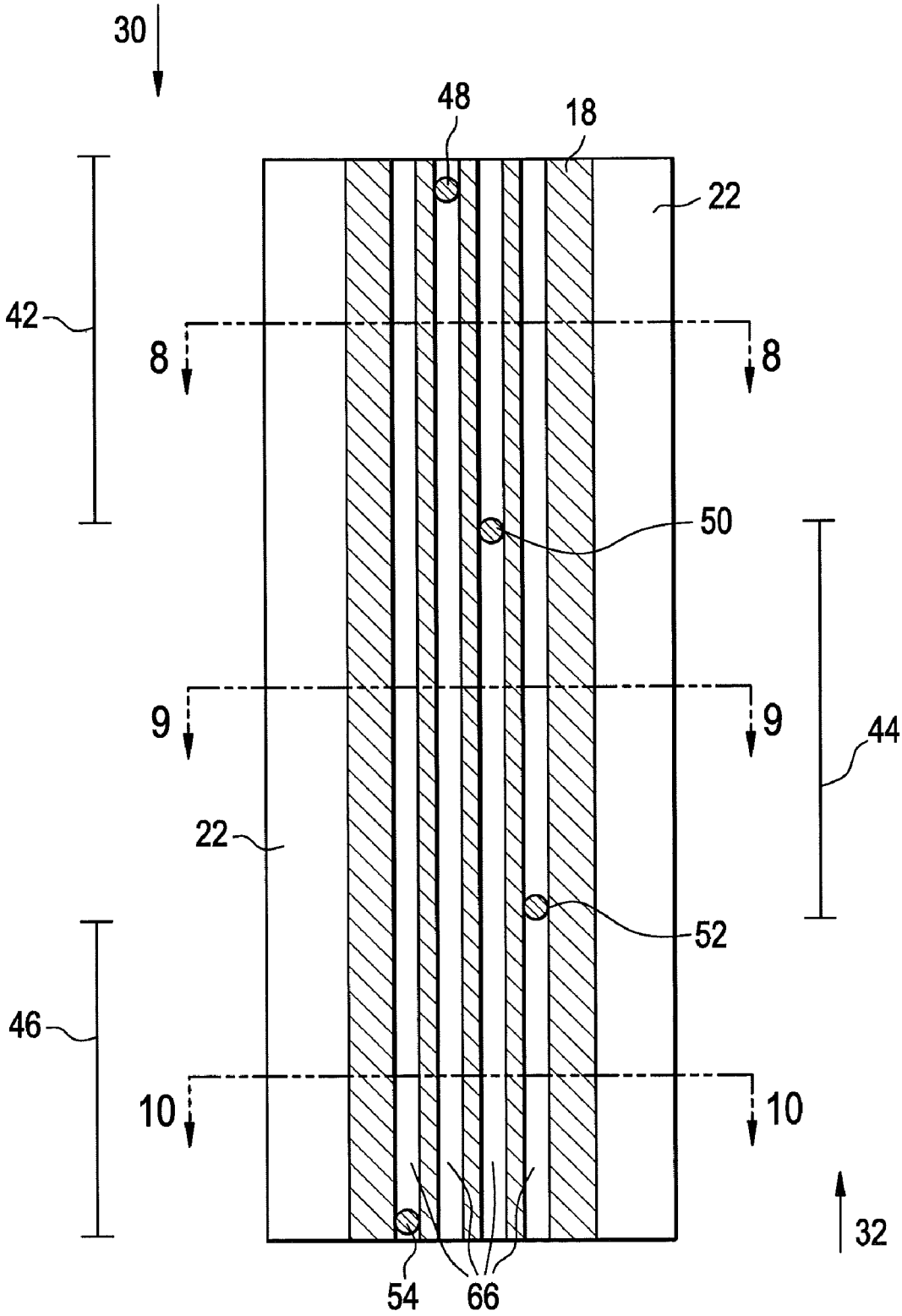
FIG. 7 is an elevation view of an inner surface of an alternate assembly track with a plurality of slots of the compressor case section of FIG. 1 as viewed along arrow 2, with the stator portions removed.
Figure 8:
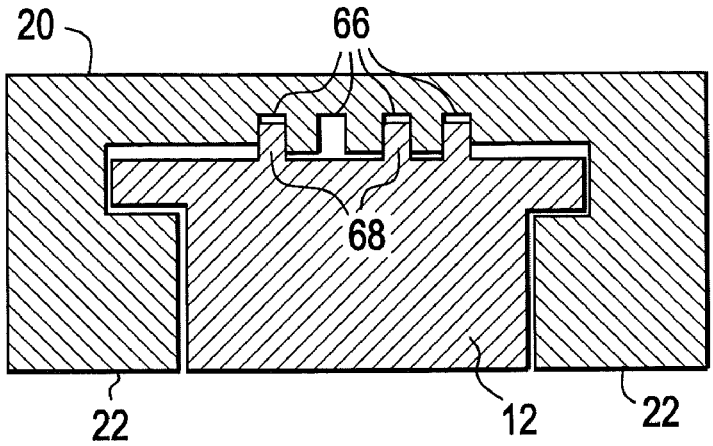
FIG. 8 is a cross sectional view of a first stator portion within the compressor case section of FIG. 7 at the first assembly location taken along arrows 8-8.
Figure 9:
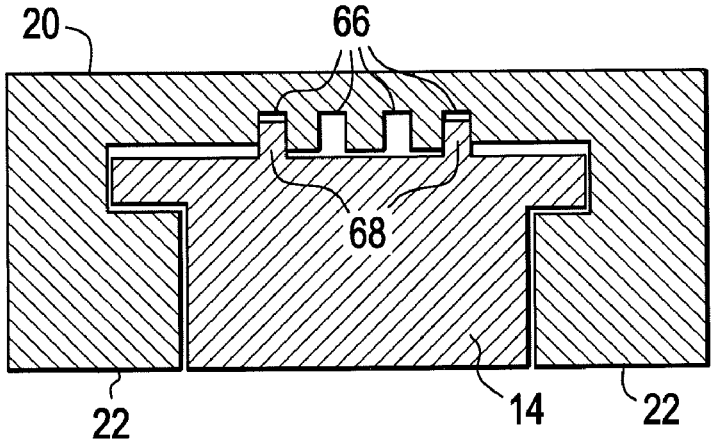
FIG. 9 is a cross sectional view of a second stator portion within the compressor case section of FIG. 6 at the second assembly location taken along arrows 9-9.
Figure 10:
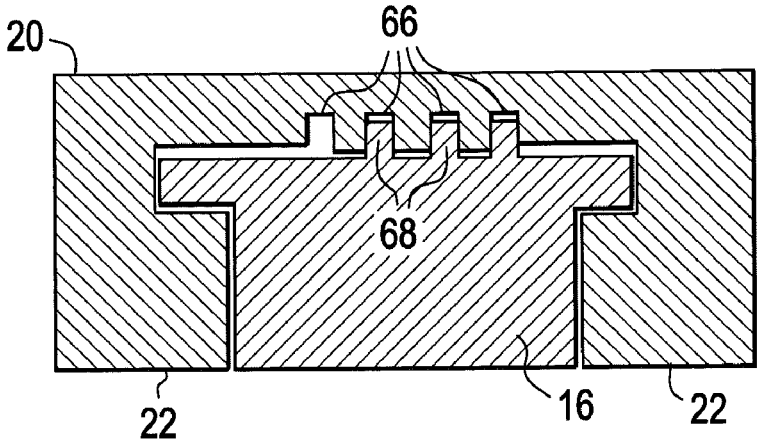
FIG. 10 is a cross sectional view of a third stator portion within the compressor case section of FIG. 6 at the third assembly location taken along arrows 10-10.

The compressor case section 11 has an outer surface 20 and an inner surface 22. The assembly track 18 is located along the inner surface 22 and extends the perimetrical length of the compressor case section 10 from a first end 24, to a second end 26. The assembly track 18 is configured to receive the set of stator portions 12, 14, 16. The stator portions 12, 14, 16 may have a square or rectangular shaped base, or any other base that is insertable into the assembly track 18. Each of the stator portions 12, 14, 16 includes at least one stator vane 28, as shown in FIG. 1. Each of the individual stator vanes 28 may comprise a size, profile, angle, or other arrangement that is different from another of the stator vanes 28. Additionally, the stator vanes 28 on one of the stator portions 12, 14, 16 may be provided in different schemes such as in, size, profile, angle or arrangement than the stator vanes 28 on another of the stator portions 12, 14, 16. Thus, the set of stator portions may comprise an arrangement having any type of non-uniform vane scheme.

The assembly track 18 may be configured to receive the stator portions 12, 14, 16 from either the first end 24 or the second end 26 during assembly. In this embodiment, the stator portions 12, 14, 16 are insertable into the assembly track 16 from the first end 24 in a first assembly direction 30 or from the second end 26 in a second assembly direction 32. In this embodiment, the assembly track 18 also includes two assembly slots 34 to provide space for two corresponding base lips 38 of the stator portions 12, 14, 16 to assist in the assembly and the retention of the stator portions 12, 14, 16 within the assembly track 18. The assembly track 18 and the stator portions 12, 14, 16 may include any other mechanism that insures that the stator portions 12, 14, 16 are held secure within the assembly track 18.

The assembly track 18 is configured to receive each of the stator portions 12, 14, 16 only within a particular assembly circumferential location 42, 44, 46. The assembly circumferential locations 42, 44, 46 for each of the stator portions 12, 14, 16 is individualized so that each individual stator portion 12, 14, 16 has a corresponding individual assembly circumferential location 42, 44, 46. These individualized assembly circumferential locations 42, 44, 46 insure the correct location for the stator vanes 28 that have a deliberate non-uniform scheme. For example, in this embodiment, the first stator portion 12 can only be assembled into the first assembly circumferential location 42, the second stator portion 14 can only be assembled into the second assembly location 44 and the third stator portion 16 can only be assembled into the third stator assembly circumferential location 46.

To insure that the stator portions 12, 14, 16 are assembled into only the correct individualized assembly circumferential locations 42, 44, 46, the assembly track 18 and the stator portions 12, 14, 16 are keyed to one another. Particularly, the assembly track 18 is keyed to include at least one protrusion 48, 50, 52, 54 and at least one of the stator portions 12, 14, 16 is keyed to include at least one stator slot 56, 58, 60. When the stator portions 12, 14, 16 are inserted into the assembly track 18, the stator slots 56, 58, 60 have a parallel alignment with the assembly directions 30, 32 and are also aligned in a horizontal direction 64 with at least one of the protrusions 48, 50, 52, 54. The protrusions 48, 50, 52, 54 may be configured so that the stator portion 12, 14, 16 is insertable in only one parallel alignment and will not be insertable if the stator 12, 14, 16 portion is flipped 180 degrees to another parallel alignment. Further, each of the stator slots 56, 58, 60 is configured to provide clearance for this corresponding protrusion 48, 50, 52, 54 to allow the stator portion 12, 14, 16 to bypass the corresponding protrusion 48, 50, 52, 54 during assembly. In one embodiment, this is achieved because each of the stator slots 56, 58, 60 has a greater depth than the height of the corresponding protrusion 48, 50, 52, 54, and a greater width than the interfering width of the corresponding protrusion 48, 50, 52, 54 in order to provide this clearance. Further, each of the protrusions 48, 50, 52, 54 is located at periodic intervals between the first end 24 and the second end 26. When one of the stator portions 12, 14, 16 does not include a corresponding stator slot 56, 58, 60 for one of the protrusions 48, 50, 52, 54, that protrusion 48, 50, 52, 54 interferes with the insertion of that stator portion 12, 14, 16. Thus, the protrusions 48, 50, 52, 54 are configured to selectively interfere with the insertion of the stator portions 12, 14, 16 into the assembly track 18.

The protrusions 48, 50, 52, 54 may be any of the following: a pin, a screw, a weldment, a bolt, or any other appropriate projection extending into the assembly track 18. The protrusions 48, 50, 52, 54 may also have a profile that is generally circular, polygonal, or any other shape. Further, in an embodiment having a plurality of the protrusions 48, 50, 52, 54, the protrusions 48, 50, 52, 54 may each have a similar height. Alternately, one or more of the protrusions 48, 50, 52, 54 may have a different height than another of the protrusions 48, 50, 52, 54.

Referring by way of example to the embodiment shown in FIGS. 1-6, the compressor case section 11 is shown having a first protrusion 48, a second protrusion 50, a third protrusion 52, and a fourth protrusion 54, with each of the protrusions 48, 50, 52, 54 being located at different positions along a direction 64. The first stator portion 12 includes a first stator slot 56. When the first stator portion 12 is inserted into the assembly track 18, the first stator slot 56 is aligned with the corresponding first protrusion 48. The first stator portion 12 is therefore insertable into the first end 24 into the first assembly circumferential location 42. The first stator portion 12 does not include a stator slot that aligns with the second protrusion 50. Therefore, the first stator portion 12 may not be inserted further in the first assembly direction 30 than the first assembly circumferential location 42 due to the interference from the second protrusion 50. Additionally, the first stator portion 12 is not insertable from the second end 26 in the second assembly direction because of the interference from the fourth protrusion 54. Hence, the first stator portion 12 may only be assembled in the correct first assembly circumferential location 42. Likewise, the second stator portion 14 includes two second stator slots 58 corresponding to the third and the fourth protrusions 52, 54. The second stator portion 14 is therefore only insertable into the assembly track 18 from the second end 26 in the second assembly direction 32 because the second stator slots 58 do not provide clearance over the first protrusion 48. The second stator slots 58 provide clearance over the third and fourth protrusions 54, 52 until the second stator portion 14 is stopped by the second protrusion 50 at the second stator assembly circumferential location 44. Finally, the third stator portion 16 includes a third stator slot 60 that corresponds to the fourth protrusion 54. The third stator portion 16 is only insertable into the assembly track 18 from the second end 26 and is stopped in the correct third assembly circumferential location 46 by the second protrusion 52. Thus, the protrusions 48, 50, 52, 54 and the corresponding stator slots 56, 58, 60 insure that the stator portions 12, 14, 16 are installed in the correct assembly circumferential locations 42, 44, 46.

Referring to FIGS. 7-10, another embodiment of the compressor case section 11 is shown further including one or more compressor case slots 66. The compressor case slots 66 are slots that extend the length of the compressor case section 11 from the first end 24 to the second end 26, and are parallel with the assembly directions 30, 32. One or more of the protrusions 48, 50, 52, 54 are located within each of the compressor case slots 66. The compressor case slots 66 correspond to one or more stator elevations 68 of the stator portions 12, 14, 16 so that each of the stator elevations 68 slides into the corresponding compressor case slot 66 when each of the stator portion 12, 14, 16 is inserted into the assembly track 16. The stator elevations 68 extend the length of the stator portion 12, 14, 16. Each of the stator portions 12, 14, 16 does not include a stator elevation 68 for each of the compressor case slots 66. When one of the stator portions 12, 14, 16 is without a stator elevation 68 for a corresponding compressor slot 66, that stator portion 12, 14, 16 is thereby configured to bypass the protrusion 48, 50, 52, 54 located within the particular compressor case slot 66. The protrusions 48, 50, 52, 54 are thereby configured to selectively interfere with the particular corresponding stator elevations 68. Whereas in the embodiment shown in FIGS. 2-6 the stator slots 56, 58, 60 provide selective clearance over the protrusions 48, 50, 52, 54, in the embodiment shown in FIGS. 7-10 the selective clearance is provided by the absence of the stator elevation 68 for the corresponding compressor case slot 66. In both embodiments, however, the keying arrangement similarly insures that the stator portions 12, 14, 16 are installed in the correct assembly circumferential locations 42, 44, 46.

In another embodiment of the present invention, the compressor case slots 66 of the compressor case section 11 have different dimensions from the compressor case slots of another compressor case section (not shown). In this embodiment, the compressor case slots 66 of the compressor case section 11 are configured to only accept the stator elevations 68 of the stator portions 12, 14, 16, and not the stator portions (not shown) having a correct assembly location in another compressor case section. Thus, in this embodiment, the compressor case slots 66 in conjunction with the stator elevations prevent incorrect stage-to-stage assembly of stator portions.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor case assembly comprising:

a compressor case section having an assembly track; and a set of stator portions being insertable in the assembly track, the compressor case section and the set of stator portions being configured such that the set of stator portions only assembles to the compressor case section in a single configuration.

2. The compressor case assembly of claim 1, wherein the assembly track has a first end and a second end, at least one first stator portion from the set of stator portions being insertable into the first end, and at least one second stator portion from the set of stator portions being insertable into the second end.

3. The compressor case assembly of claim 1, wherein the assembly track is keyed with at least one protrusion.

4. The compressor case assembly of claim 3, wherein the at least one protrusion is a component selected from a group consisting of a pin, a screw, a weldment, and a bolt.

5. The compressor case assembly of claim 3, further comprising a plurality of protrusions, each of the plurality of protrusions being located at intervals along a length of the assembly track, and each of the plurality of protrusions being located at intervals along a width of the assembly track.

6. The compressor case assembly of claim 3, wherein at least one stator portion of the set of stator portions is keyed with at least one stator slot.

7. The compressor case assembly of claim 6, wherein the at least one stator slot provides clearance for the at least one protrusion when the at least one stator portion is inserted into the assembly track further than the at least one protrusion.

8. The compressor case assembly of claim 1, wherein the set of stator portions comprise a non-uniform vane scheme.

9. The compressor case assembly of claim 1, wherein the compressor case section has at least one compressor case slot.

10. The compressor case assembly of claim 9, wherein at least one protrusion is located within at least one of at least one compressor case slots.

11. The compressor case assembly of claim 9, wherein at least one stator portion from the set of stator portions has a stator elevation, a compressor case slot being configured to receive the stator elevation when the at least one stator portion is inserted into the assembly track.

12. The compressor case assembly of claim 9, wherein the at least one compressor case slot of the compressor case section is non-receptive to an elevation of a stator portion, the stator elevation insertable into a compressor case slot of a different compressor case section.

13. The compressor case assembly of claim 9, wherein the compressor case section includes a plurality of case slots, a protrusion being located within each compressor case slot.

14. A method of insuring proper installation of stator portions to a compressor case comprising:

inserting a set of stator portions into an assembly track of the compressor case, the assembly track and the set of stator portions each being keyed such that each of the stator portions only assembles to the compressor case in a single configuration.

15. The method of insuring proper installation of stator portions to a compressor case of claim 14, further comprising inserting at least one stator portion of the set of stator portions into a first end of the assembly track and inserting at least one stator portion of the set of stator portions into a second end of the assembly track.

16. A method of insuring proper installation of stator portions to a compressor case comprising:

keying an assembly track of the compressor case; and keying each of a set of stator portions such that the set of stator portions only assembles to the compressor case in a single configuration.

17. The method of insuring proper installation of stator portions to a compressor case of claim 16, further comprising inserting the set of stator portions into the assembly track.

18. The method of insuring proper installation of stator portions to a compressor case of claim 16, further comprising slotting the assembly track such that a stator portion from a separate set of stator portions is prevented from being inserted into the assembly track.

19. The method of insuring proper installation of stator portions to a compressor case of claim 16, further comprising inserting at least one stator portion of the set of stator portions into a first end of the assembly track and inserting at least one stator portion of the set of stator portions into a second end of the assembly track.

* * * * *